US007478612B2

(12) United States Patent
Shiozaki et al.

(10) Patent No.: US 7,478,612 B2
(45) Date of Patent: Jan. 20, 2009

(54) ENGINE COOLING APPARATUS

(75) Inventors: Eiko Shiozaki, Saitama (JP); Hirotaka Haze, Saitama (JP); Hodaka Mukouhara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 147 days.

(21) Appl. No.: 11/527,602

(22) Filed: Sep. 27, 2006

(65) Prior Publication Data

US 2007/0074681 A1 Apr. 5, 2007

(30) Foreign Application Priority Data

Sep. 30, 2005 (JP) ..... 2005-287129

(51) Int. Cl.
*F01P 7/14* (2006.01)

(52) U.S. Cl. ..... 123/41.1; 123/41.08

(58) Field of Classification Search ..... 123/41.08, 123/41.09, 41.1

See application file for complete search history.

(56) References Cited

U.S. PATENT DOCUMENTS 5,701,851 A * 12/1997 Nakano et al. ..... 123/41.1
6,213,063 B1 * 4/2001 Nakano et al. ..... 123/41.44
6,267,087 B1 * 7/2001 Takahashi et al. ..... 123/41.44
6,446,586 B2 * 9/2002 Fukamachi ..... 123/41.1
6,505,581 B2 * 1/2003 Niizuma et al. ..... 123/41.82 R
6,702,054 B2 * 3/2004 Schneider et al. ..... 180/229
6,978,742 B2 * 12/2005 Miyagawa et al. ..... 123/41.1
7,082,904 B2 * 8/2006 Takano ..... 123/41.1
7,104,239 B2 * 9/2006 Kawakubo et al. ..... 123/192.2
7,159,682 B2 * 1/2007 Arnold ..... 180/229
7,347,169 B2 * 3/2008 Nagahashi et al. ..... 123/41.35
2005/0263110 A1 * 12/2005 Yasui ..... 123/41.72
2007/0221160 A1 * 9/2007 Haze et al. ..... 123/197.1
2008/0053385 A1 * 3/2008 Negoro et al. ..... 123/41.31

FOREIGN PATENT DOCUMENTS

JP 1-277617 A 11/1989
JP 2003-20942 * 1/2003
JP 2007-92737 * 4/2007

* cited by examiner

*Primary Examiner*—Hai H Huynh
(74) *Attorney, Agent, or Firm*—Birch, Stewart, Kolasch & Birch, LLP

(57) ABSTRACT

An engine cooling apparatus includes a cooling water outlet communicating with a water jacket provided in a cylinder block and a cylinder head provided on an intake port side of the cylinder head. A thermostat switches a path for cooling water discharged from the cooling water outlet, according to a cooling water temperature. A thermostat case for the thermostat is disposed downward of a line L extended from a coupling surface between a cylinder block and a cylinder head. The thermostat case and the cooling water outlet are connected via a connecting pipe. This arrangement makes it easy to secure a space for disposing the thermostat.

20 Claims, 4 Drawing Sheets

ENGINE COOLING APPARATUS

CROSS-REFERENCE TO RELATED APPLICATION

The present application claims priority under 35 U.S.C. §119 to Japanese Patent Application No. 2005-287129, filed Sep. 18, 2005, the entire contents of which are hereby incorporated by reference.

BACKGROUND OF THE INVENTION

1. Field of the Invention

The present invention relates to an engine cooling apparatus wherein a cooling water outlet communicated with a water jacket provided in a cylinder block and a cylinder head is provided on an intake port side of the cylinder head, and wherein a thermostat to switch, according to a cooling water temperature, a path for cooling water discharged from the cooling water outlet is connected to the cooling water outlet.

2. Description of Background Art

An engine cooling apparatus having a forwardly and upwardly inclined cylinder axis and being mounted on a motorcycle, wherein a cylinder head is provided with an intake port extending approximately upwardly to form, in an upward area, an acute angle with the cylinder axis, and wherein a thermostat is disposed in a rear vicinity of a cylinder bore connected to the intake port has been known, for example, as disclosed in JP Patent No. 2637766.

With the structure of the cooling apparatus disclosed in JP Patent No. 2637766, however, it is difficult to secure a space for disposing the thermostat in a case where the intake port provided for the cylinder head is disposed horizontally.

SUMMARY AND OBJECTS OF THE INVENTION

The present invention has been made in view of the above circumstances, and a first object of the present invention is to provide an engine cooling apparatus which allows a space for disposing a thermostat to be secured easily.

Also, in the structure disclosed in JP Patent No. 2637766, the thermostat is disposed upward of the cylinder head, so that the thermostat is positioned in a highest portion of a cooling water circulation path including a water jacket provided for the cylinder block and cylinder head of the engine. This requires the thermostat case for the thermostat to be provided with an air bleeding means.

The present invention has been made in view of the above circumstances, and a second object of the present invention is to provide an engine cooling apparatus wherein no air bleeding means is required on the thermostat side.

To address the first problem, a first aspect of the present invention provides an engine cooling apparatus including: a cooling water outlet that is communicated with a water jacket provided in a cylinder block and a cylinder head and that is provided on an intake-ports side of the cylinder head; and a thermostat to switch, according to a cooling water temperature, a path for cooling water discharged from the cooling water outlet, that is connected to the cooling water outlet. A thermostat case for the thermostat is disposed downward of a line extended from a coupling surface between the cylinder block and the cylinder head; and the thermostat case and the cooling water outlet are connected via a connecting pipe.

To address the second problem, a second aspect of the present invention provides an engine cooling apparatus including: a cooling water outlet that is communicated with a water jacket provided in a cylinder block and a cylinder head and that is provided on an intake-ports side of the cylinder head; and a thermostat to switch, according to a cooling water temperature, a path for cooling water discharged from the cooling water outlet, that is connected to the cooling water outlet. An air bleeding member communicated with the water jacket is attached to the cylinder head; a thermostat case for the thermostat is disposed downward of the air bleeding member; and the thermostat case and the cooling water outlet are connected via a connecting pipe which has an upper inner wall surface inclined to be gradually higher toward the cooling water outlet.

According to a third aspect of the present invention, a transmission case disposed, when mounted on a vehicle, rearward of the cylinder block is linked to a crankcase rotatably supporting a crankshaft and being connected to the cylinder block. In addition, a starter motor overlapping, at least partly, with the thermostat case as seen from a side is disposed upward of the transmission case.

According to a fourth aspect of the present invention, a clutch housing portion having a bulgy top which, as seen from a side, overlaps with the thermostat case is formed in an end portion, along an axis of the crankshaft, of the transmission case. Further, an upstream end of a cooling water hose extending along the axis of the crankshaft is, at upward of the transmission case, connected to the thermostat case with a downstream end of the cooling water hose connected to a radiator.

EFFECT OF THE INVENTION

According to the first aspect of the present invention, the thermostat case for the thermostat is disposed downward of the line extended from the coupling surface between the cylinder block and the cylinder head, so that the thermostat case is disposed on a side away from the intake device connected to the intake ports. This makes it easy to secure a space for disposing the thermostat and increases flexibility in disposing, for example, the air cleaner in the intake device.

According to the second aspect of the present invention, the thermostat case is disposed downward of the air bleeding member attached to the cylinder head, and the connecting pipe connecting the thermostat case and the cooling water outlet has the upper inner wall surface that is inclined to be gradually higher toward the cooling water outlet. Therefore, the thermostat case requires no air bleeder, and no space for air bleeding is required to be secured around the thermostat case. This makes it possible to simplify the structure of the thermostat case and reduce the number of steps required to process and install the thermostat case.

According to the third aspect of the present invention, it is possible to secure a space for disposing the thermostat case beside the starter motor and make the engine as a whole compact.

According to the fourth aspect of the present invention, the cooling water hose that leads the cooling water coming from the thermostat for circulation to the radiator side can be disposed with minimum bending so as to allow the cooling water to flow smoothly. In addition, the cooling water hose can be laid in the vicinity of the cylinder block to allow the engine as a whole to be made compact.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
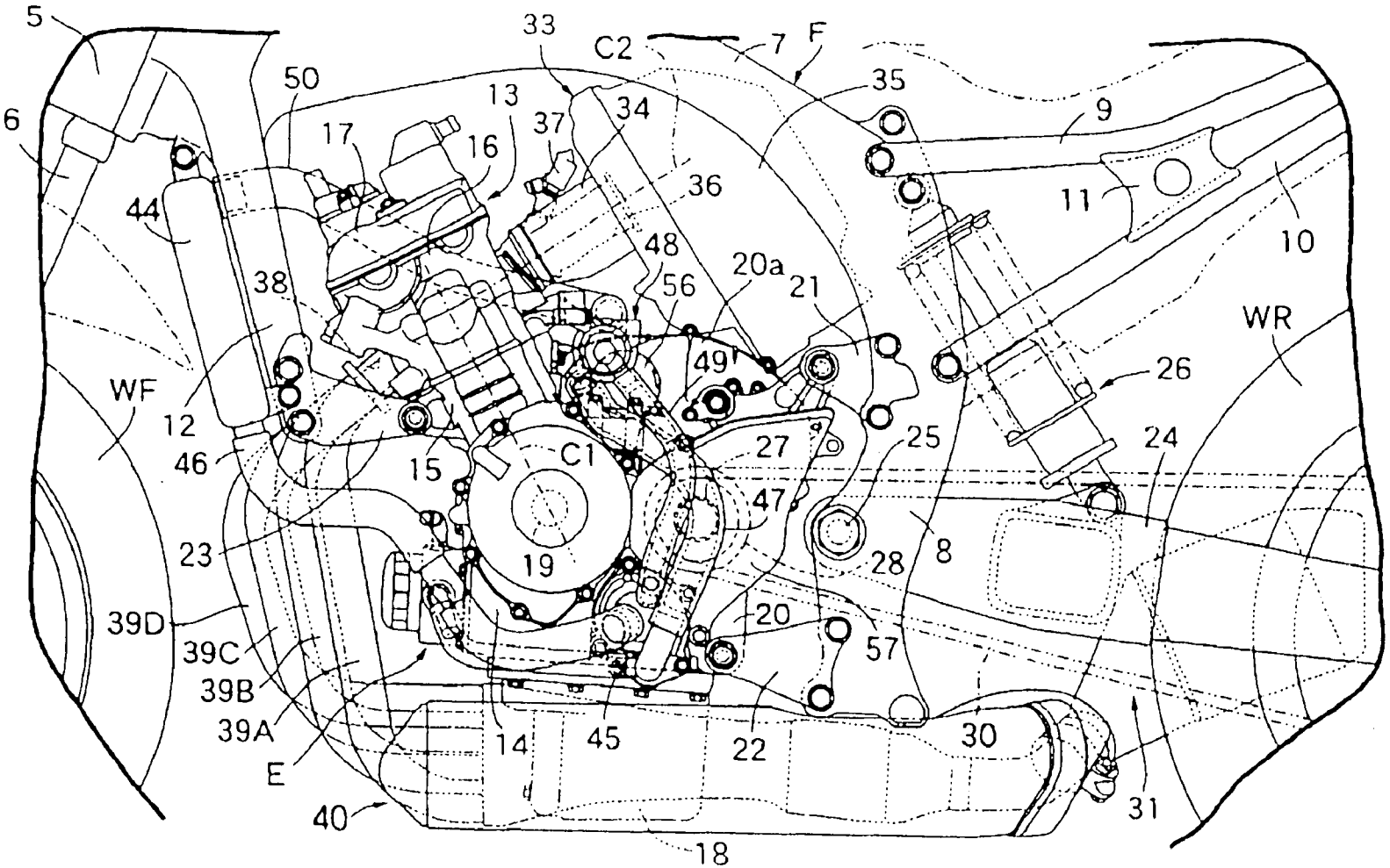
FIG. 1 is a side view showing an essential part of a motorcycle.

With reference to FIG. 1, a head pipe 5 is provided at a front end of a body frame F of a motorcycle, and a front fork 6 supporting a front wheel WF is steerably supported by the head pipe 5. A pivot frame 8 extending downwardly is integrally attached to a rear portion of a pair of left and right main frames 7 extending rearwardly from the head pipe 5. A front end portion of a seat rail 9 extending rearwardly and upwardly is connected to a rear portion of the main frames 7. A front end of a rear frame 10 extending, at downward of the seat rail 9, rearwardly and upwardly is connected to a vertically intermediate portion of the pivot frame 8. The seat rail 9 and the rear frame 10 are connected by a connecting member 11. An upper portion of an engine hanger 12 extending downwardly is connected to the head pipe 5 and a front portion of the main frame 7.

An engine main body 13 including a four-cylinder engine E wherein four cylinders are arranged in parallel along the width of the body frame F is disposed downward of the main frames 7. The engine main body 13 is supported at vertically intermediate and lower portions of the pivot frame 8 and a lower portion of the engine hanger 12.

Figure 2:
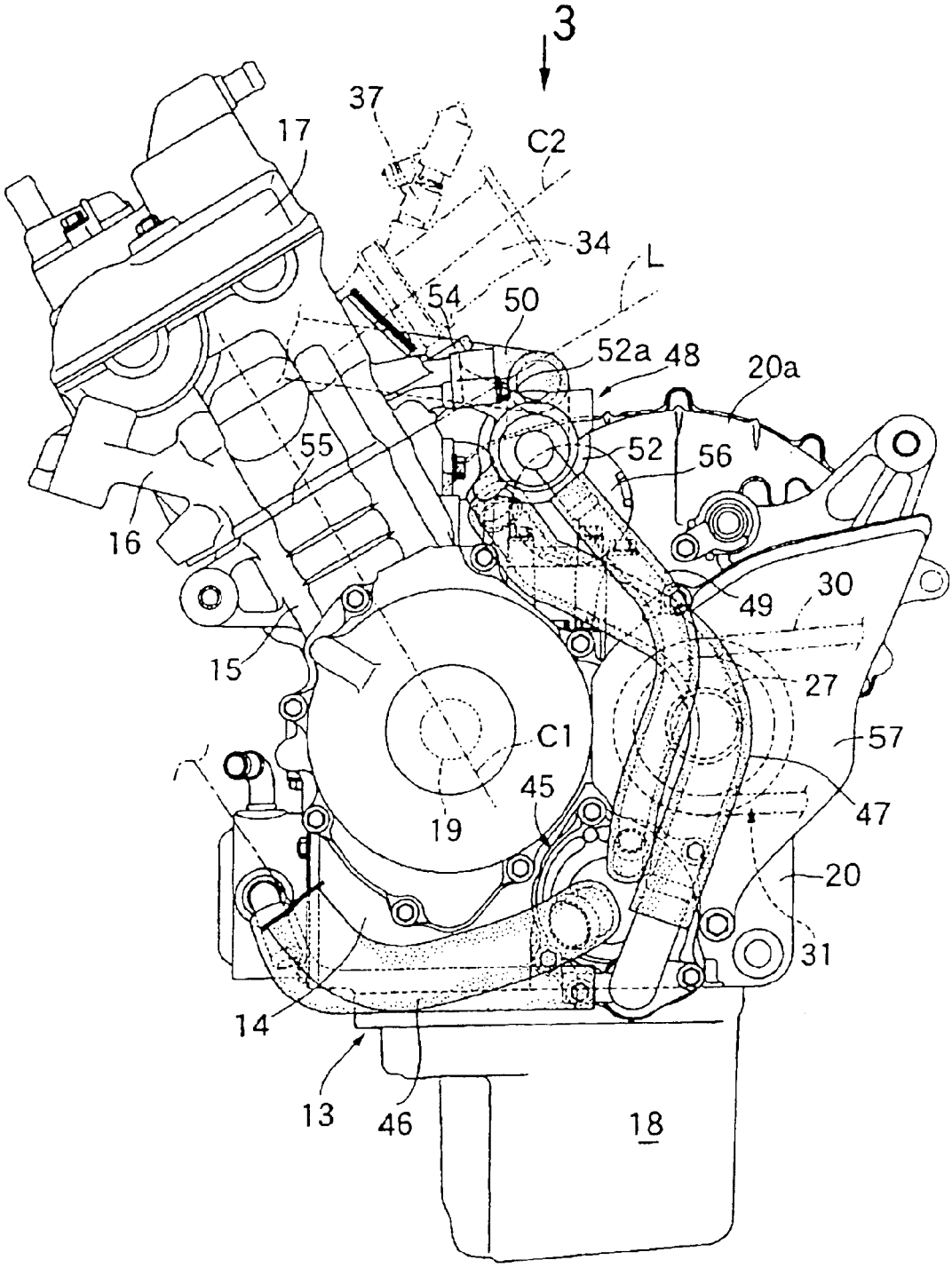
FIG. 2 is an enlarged side view of an engine.

Now with reference also to FIG. 2, the engine main body 13 includes a crankcase 14, a cylinder block 15 connected to an upper portion of the crankcase 14, a cylinder head 16 connected to an upper portion of the cylinder block 15, a head cover 17 connected to an upper portion of the cylinder head 16, and an oil pan 18 connected to a lower portion of the crankcase 14. The engine main body 13 is mounted on the body frame F in a position wherein a cylinder axis C1 is inclined frontwardly and upwardly.

The crankcase 14 rotatably supports a crankshaft 19 whose axis extends along the width of the body frame F. A transmission case 20 housing a transmission (not shown) which changes the rotary output of the crankshaft 19 is integrally connected to the crankcase 14 such that the transmission case 20 is, when mounted on a motorcycle, positioned rearward of the cylinder block 15.

Brackets 21 and 22 are fastened to vertically intermediate and lower portions of the pivot frame 8, respectively. Upper and lower portions of the transmission case 20 are fastened to the brackets 21 and 22, respectively. A bracket 23 is fastened to a lower portion of the engine hanger 12. A front portion of the cylinder block 15 is fastened to the bracket 23.

A rear wheel WR is pivotally supported at a rear portion of a swing arm 24. A front portion of the swing arm 24 is swingably supported, at a portion between brackets 21 and 22 of the pivot frame 8, by the pivot frame 8 via a spindle 25. A rear cushion unit 26 is provided between a rear portion of the main frame 7 and the swing arm 24.

The rotary power of an output shaft 27 with which the transmission is provided is transmitted to the rear wheel WR via chain drive means 31 including a drive sprocket 28 fixed to the output shaft 27, a driven sprocket (not shown) fixed to the shaft of the rear wheel WR, and an endless chain 30 wound around the drive sprocket 28 and the driven sprocket.

Figure 3:
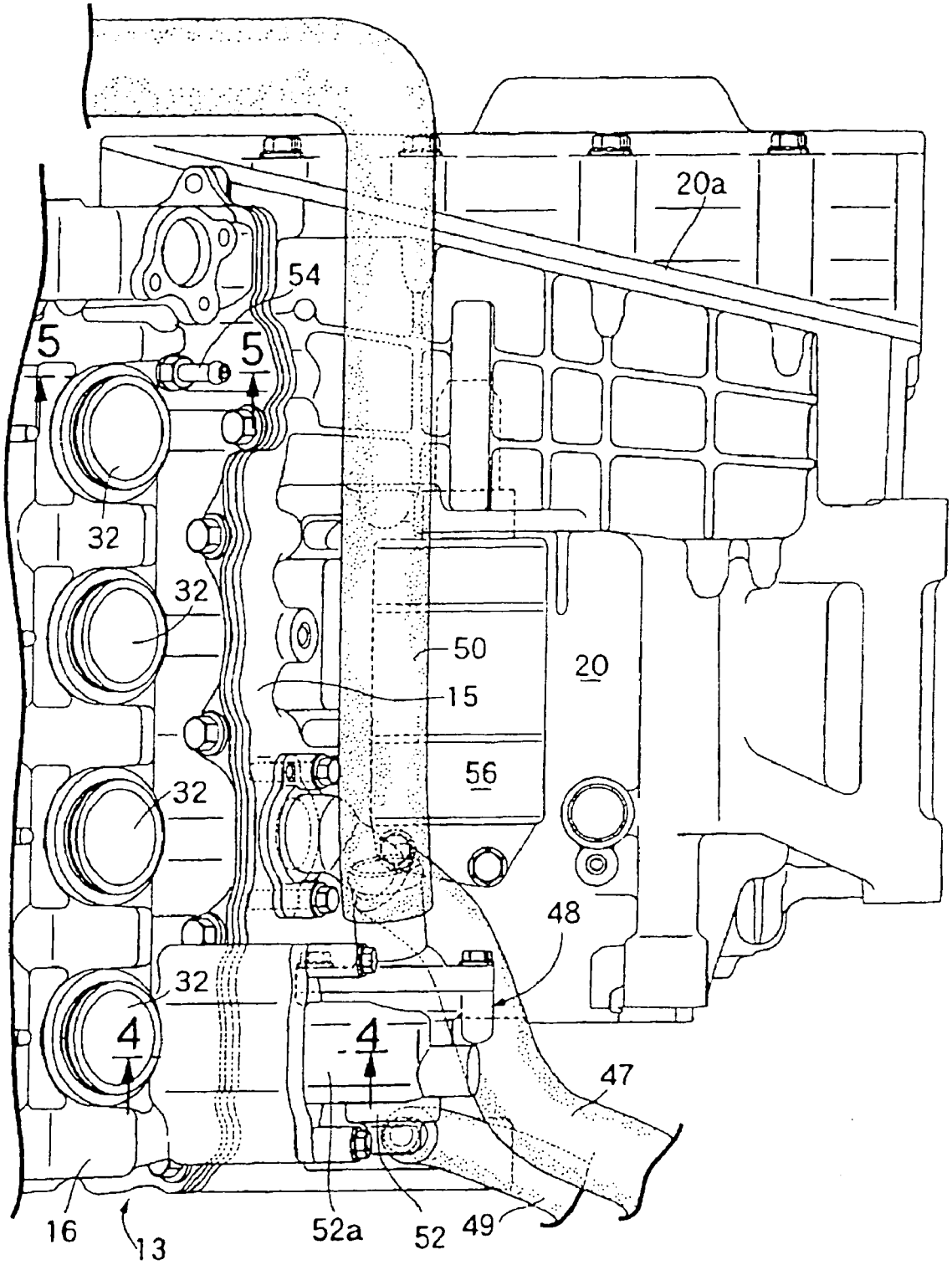
FIG. 3 is a view on arrow 3 in FIG. 2.

With reference also to FIG. 3, on a side in a rear portion of the cylinder head 16, spaced-apart intake ports 32 individually corresponding to the cylinders are arranged in parallel along the width of the body frame F. An intake device 33 is connected to the intake ports 32.

As can be seen in FIG. 1, the intake device 33 includes throttle bodies 34 individually connected to the intake ports 32 and an air cleaner 35 to which upstream ends of the throttle bodies 34 are commonly connected. An intake axis C2 of an intake passage 36 formed in each of the throttle bodies 34 is set such that it extends rearwardly and upwardly to be approximately orthogonal to the cylinder axis C1 extending frontwardly and upwardly. Each of the throttle bodies 34 is attached with a fuel injection valve 37, the fuel injection valves 37 individually corresponding to the cylinders.

With reference to FIG. 1 again, on a side in a front portion of the cylinder head 16, spaced-apart exhaust ports 38 individually corresponding to the cylinders are arranged in parallel along the width of the body frame F. An exhaust device 40 is connected to the exhaust ports 38. The exhaust device 40 has four exhaust pipes 39A, 39B, 39C, and 39D whose upstream ends are individually connected the exhaust ports 38. The exhaust device 40 extends to the right side of the rear wheel WR via the right side of the oil pan 18 located below the engine main body 13 and the rear side and the left side of the rear wheel WR.

A radiator 44 is disposed in front of the engine hanger 12. The radiator 44 is supported by the head pipe 5 and the engine hanger 12. A water pump 45 rotationally driven by the power transmitted from the crankshaft 19 is attached to the left side of the transmission case 20. The cooling water cooled by the radiator 44 is sucked into the water pump 45 via a first cooling water hose 46.

Figure 4:
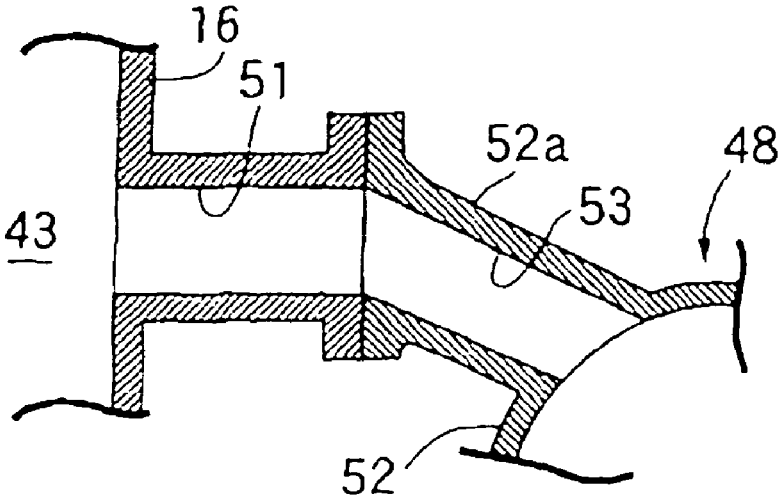
FIG. 4 is an enlarged cross-sectional view on line 4-4 in FIG. 3.
Figure 5:
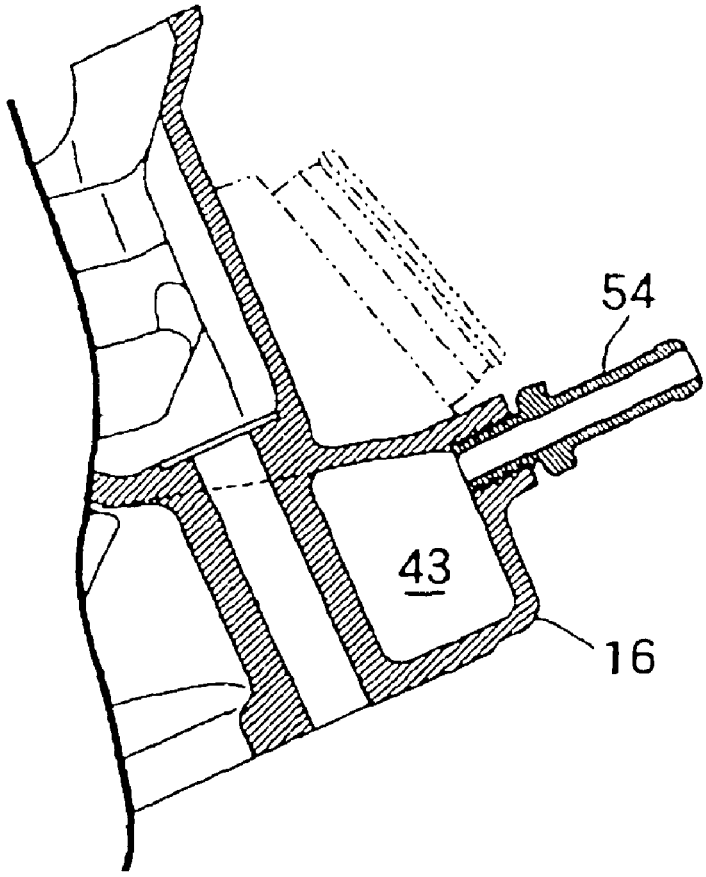
FIG. 5 is an enlarged cross-sectional view on line 5-5 in FIG. 3.

The cylinder block 15 and the cylinder head 16 are provided with a water jacket 43 (see FIGS. 4 and 5). The cooling water discharged from the water pump 45 is supplied to the water jacket 43 in the cylinder block 15 via a second cooling water hose 47. The path for the cooling water discharged from the water jacket 43 in the cylinder head 16 is switched by a thermostat 48 according to the temperature of the cooling water. Namely, the thermostat 48 adjusts the proportion between the volume of water returned to the water jacket 45 and the volume of water supplied to the radiator 44 out of the cooling water discharged from the water jacket 43 in the cylinder head 16. The thermostat 48 and the water pump 45 are connected by a third cooling water hose 49 which is used by the cooling water to be returned to the water pump 45. The thermostat 48 and the radiator 44 are connected by a fourth cooling water hose 50 which is used by the cooling water to be supplied to the radiator 44.

With reference to FIG. 4, a cooling water outlet 51 leading to the water jacket 43 is provided on the intake-ports-32 side of the cylinder head 16, i.e. in a left end portion of a rear side of the cylinder head 16. The thermostat 48 is connected to the cooling water outlet 51.

With reference to FIG. 5, an air bleeding member 54, which may be tubular, is attached to the intake-ports-32 side of the cylinder head 16, i.e. in a portion toward the right end of a rear side of the cylinder head 16. The air bleeding member 54 is arranged to communicate with a highest interior portion of the water jacket 43.

The thermostat 48 is connected to the cooling water outlet 51. A thermostat case 52 for the thermostat 48 is disposed downward of the air bleeding member 54 and downward of a line L extended from a coupling surface 55 between the cylinder block 15 and the cylinder head 16. The thermostat case 52 is fastened to the cylinder block 15.

The thermostat case 52 and the cooling water outlet pipe 51 are connected via a connecting pipe 52*a*. Even though, in the present embodiment, the connecting pipe 52*a* and the thermostat case 52 are formed in a unitary structure, the connecting pipe 52*a* may be a discrete member. An upper inner wall surface 53 of the connecting pipe 52*a* is inclined to be gradually higher toward the cooling water outlet 51.

The thermostat case 52 is disposed upward of the transmission case 20 that is connected, to be rearward of the cylinder block 15, to the crankcase 14. A starter motor 56 is disposed upward of the transmission case 20 such that it overlaps at least partly with the thermostat case 52 as seen from a side.

In an end portion, i.e. in a right end portion in the present embodiment, along the axis of the crankshaft 19, a clutch housing portion 20*a* having a bulgy top so as to accommodate a clutch (not shown) provided between the transmission in the transmission case 20 and the crankshaft 19 is formed. The clutch housing portion 20*a* is formed such that its top portion overlaps with the thermostat case 52 as seen from a side. The fourth cooling water hose 50 whose upstream end is connected to the thermostat case 52 so as to lead the cooling water coming from the thermostat 48 to the radiator 44 is disposed such that it extends, at upward of the transmission case 20, along the axis of the crankshaft 19. The downstream end of the fourth cooling water hose 50 disposed to extend round the right side of the engine main body 13 is connected to the radiator 44 disposed in front of the engine main body 13.

The second cooling water hose 47 extends downwardly from a rear side of the cylinder block 15, connecting the rear side of the cylinder block 15 and the water pump 45. The third cooling water hose 49 extends downwardly from the thermostat case 52, connecting the thermostat case 52 and the water pump 45. The second cooling water hose 47 and the third cooling water hose 49 are disposed such that they extend overlapping, as seen from a side, with the drive sprocket 28 of the chain drive means 31.

The transmission case 20 is attached with a cover 57 which covers, from outside, where the drive sprocket 28 of the chain drive means 31 is disposed. The second cooling water hose 47 and the third cooling water hose 49 are disposed outside the cover 57.

Next, how the present embodiment works will be described. The thermostat 48 is connected to the cooling water outlet 51 provided on the intake-ports-32 side of the cylinder head 16 so that the thermostat 48 is communicated with the water jacket 43 provided for the cylinder block 15 and the cylinder head 16. The thermostat case 52 for the thermostat 48 is disposed downward of the line L extended from the coupling surface 55 between the cylinder block 15 and the cylinder head 16. The thermostat case 52 and the cooling water outlet pipe 51 are connected via the connecting pipe 52*a*.

The thermostat case 52 for the thermostat 48 is disposed on a side away from the intake device 33 connected to the intake ports 32. This makes it easy to secure a space for disposing the thermostat 48 and increases flexibility, for example, in disposing the air cleaner 35 in the intake device 33. In the present embodiment, the intake axis C2 of each of the throttle bodies 34 included in the intake device 33 is set such that it extends rearwardly and upwardly to be approximately orthogonal to the cylinder axis C1 extending frontwardly and upwardly, so that it is easier to secure a suitable free space downward of the throttle bodies 34 for disposing the thermostat 48. This can contribute toward increasing the capacity of the air cleaner 35.

The cylinder head 16 is attached with the air bleeding member 54 being communicated with the water jacket 43. The thermostat case 52 is disposed downward of the air bleeding member 54. Since the thermostat case 52 and the cooling water outlet 51 are connected by the connecting pipe 52*a* having the upper inner wall surface 53 inclined to be gradually higher toward the cooling water outlet 51, the thermostat case 52 requires no air bleeder. Therefore, it is not necessary to secure a space for air bleeding around the thermostat case 52. This makes it possible to simplify the structure of the thermostat case 52 and reduce the number of steps required to process and install the thermostat case 52.

The transmission case 20 disposed rearward of the cylinder block 15 is connected to the crankcase 14. The starter motor 56 is disposed upward of the transmission case 20 such that it overlaps at least partly with the thermostat case 52 as seen from a side. It is therefore possible to secure a space for disposing the thermostat case 52 beside the starter motor 56 and make the engine E as a whole compact.

The clutch housing portion 20*a* having a bulgy top which overlaps with the thermostat case 52 as seen from a side is formed in a right end portion of the transmission case 20. The upstream end of the fourth cooling water hose 50 extending along the axis of the crankshaft 19 is connected, in a location upward of the transmission case, to the thermostat case 52. The downstream end of the fourth cooling water hose 50 is connected to the radiator 44. In this arrangement, the fourth cooling water hose 50 that leads the cooling water coming from the thermostat 48 for circulation to the radiator 44 side can be disposed with minimum bending so as to allow the cooling water to flow smoothly. In addition, the fourth cooling water hose 50 can be laid in the vicinity of the cylinder block 15 to allow the engine E as a whole to be made compact.

The second cooling water hose 47 that extends downwardly from a rear side of the cylinder block 15, connecting the rear side of the cylinder block 15 and the water pump 45, and the third cooling water hose 49 that extends downwardly from the thermostat case 52, connecting the thermostat case 52 and the water pump 45, are disposed outside the cover 57 that covers, from outside, where the drive sprocket 28 of the chain drive means 31 is disposed. In this arrangement, not only the cover 57 can reduce the release of noise generated where the drive sprocket 28 and the chain 30 engage with each other, the second cooling water hose 47 and the third cooling water hose 49 can absorb some of the noise, so that the engine E can be made quieter.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine cooling apparatus comprising:

a cooling water outlet that communicates with a water jacket provided in a cylinder block and a cylinder head, said cooling water outlet being provided on an intake-ports-side of the cylinder head; and a thermostat to switch, according to a cooling water temperature, a path for cooling water discharged from the cooling water outlet, that is connected to the cooling water outlet, wherein a thermostat case for the thermostat is disposed in its entirety downward of a line extended from a coupling surface between the cylinder block and the cylinder head, and the thermostat case and the cooling water outlet are connected via a connecting pipe.

2. The engine cooling apparatus according to claim 1, further comprising a transmission case that is integrally connected to a crankcase such that the transmission case is, when mounted on a motorcycle, positioned rearward of the cylinder block, the crankcase supporting a crankshaft, and wherein a starter motor, at least partly overlapping with the thermostat case as seen from a side, is disposed upward of the transmission case.

3. The engine cooling apparatus according to claim 2, further comprising:

a clutch housing portion formed in an end portion, along an axis of the crankshaft, of the transmission case, the clutch housing portion having a bulgy top, which as seen from the side, overlaps with the thermostat case, and a cooling water hose extending along the axis of the crankshaft, the cooling water hose having an upstream end that is connected to the thermostat case at a position upward of the transmission case, and a downstream end of that is connected to a radiator.

4. The engine cooling apparatus according to claim 1, further comprising:

a starter motor disposed upward of a transmission case, and a clutch housing portion having a bulgy top formed in an end portion, along an axis of the crankshaft, of the transmission case, and when seen from a side, the starter motor, the bulgy top of the transmission case and the thermostat case at least partly overlap with each other.

5. The engine cooling apparatus according to claim 1, wherein the cooling water outlet leading to the water jacket is provided on a left end portion of a rear side of the cylinder head.

6. The engine cooling apparatus according to claim 1, further comprising an air bleeding member arranged to communicate with a highest interior portion of the water jacket.

7. The engine cooling apparatus according to claim 6, wherein the air bleeding member is attached to a portion of the cylinder head toward a right end of a rear side of the cylinder head.

8. The engine cooling apparatus according to claim 1, further comprising an air bleeding member communicating with the water jacket, the air bleeding member and the water cooling outlet being disposed at opposite end portions of the cylinder head in a right and left direction.

9. The engine cooling apparatus according to claim 1, wherein the connecting pipe and the thermostat case are formed in a unitary structure.

10. The engine cooling apparatus according to claim 1, wherein the connecting pipe is a discrete member.

11. An engine cooling apparatus comprising:

a cooling water outlet that communicates with a water jacket provided in a cylinder block and a cylinder head, said cooling water outlet being provided on an intake-ports-side of the cylinder head; and a thermostat to switch, according to a cooling water temperature, a path for cooling water discharged from the cooling water outlet, that is connected to the cooling water outlet, wherein an air bleeding member communicated with the water jacket is attached to the cylinder head, a thermostat case for the thermostat is disposed downward of the air bleeding member, and a starter motor disposed upward of a transmission case, the starter motor at least partly overlapping with the thermostat case when seen from a side, wherein the thermostat case and the cooling water outlet are connected via a connecting pipe which has an upper inner wall surface inclined to be gradually higher toward the cooling water outlet.

12. The engine cooling apparatus according to claim 11, wherein the transmission case is integrally connected to a crankcase such that the transmission case is, when mounted on a motorcycle, positioned rearward of the cylinder block, the crankcase supporting a crankshaft.

13. An engine cooling apparatus comprising:

a cooling water outlet that communicates with a water jacket provided in a cylinder block and a cylinder head, said cooling water outlet being provided on an intake-ports-side of the cylinder head; and a thermostat to switch, according to a cooling water temperature, a path for cooling water discharged from the cooling water outlet, that is connected to the cooling water outlet, wherein an air bleeding member communicated with the water jacket is attached to the cylinder head, a thermostat case for the thermostat is disposed downward of the air bleeding member, the thermostat case and the cooling water outlet being connected via a connecting pipe which has an upper inner wall surface inclined to be gradually higher toward the cooling water outlet, a clutch housing portion formed in an end portion, along an axis of a crankshaft, of a transmission case, the clutch housing portion having a bulgy top, which as seen from a side, overlaps with the thermostat case, and a cooling water hose extending along the axis of the crankshaft, the cooling water hose having an upstream end that is connected to the thermostat case at a position upward of the transmission case, and a downstream end of that is connected to a radiator.

14. The engine cooling apparatus according to claim 11, further comprising a clutch housing portion having a bulgy top formed in an end portion, along an axis of the crankshaft, of the transmission case, and when seen from the side, the starter motor, the bulgy top of the transmission case and the thermostat case at least partly overlap with each other.

15. The engine cooling apparatus according to claim 11, wherein the cooling water outlet leading to the water jacket is provided on a left end portion of a rear side of the cylinder head.

16. The engine cooling apparatus according to claim 11, wherein the air bleeding member is arranged to communicate with a highest interior portion of the water jacket.

17. The engine cooling apparatus according to claim 16, wherein the air bleeding member is attached to a portion of the cylinder head toward a right end of a rear side of the cylinder head.

18. The engine cooling apparatus according to claim 11, wherein the air bleeding member and the water cooling outlet are disposed at opposite end portions of the cylinder head in a right and left direction.

19. The engine cooling apparatus according to claim 11, wherein the connecting pipe and the thermostat case are formed in a unitary structure.

20. The engine cooling apparatus according to claim 11, wherein the connecting pipe is a discrete member.

* * * * *